US010352535B2

(12) United States Patent
Zhu et al.

(10) Patent No.: US 10,352,535 B2
(45) Date of Patent: Jul. 16, 2019

(54) MAGNETIC MOUNTING ELEMENT, OPTICAL MODULE, ILLUMINATION MODULE AND ILLUMINATION LAMP

(71) Applicant: OPPLE LIGHTING CO., LTD., Shanghai (CN)

(72) Inventors: Kunlun Zhu, Shanghai (CN); Ruikai Lian, Shanghai (CN); Xuanxiong Gu, Shanghai (CN); Jianguo Li, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 177 days.

(21) Appl. No.: 15/597,586

(22) Filed: May 17, 2017

(65) Prior Publication Data

US 2017/0254516 A1 Sep. 7, 2017

Related U.S. Application Data

(63) Continuation of application No. PCT/CN2015/000843, filed on Dec. 2, 2015.

(30) Foreign Application Priority Data

Dec. 12, 2014 (CN) ..... 2014 1 0767253
Dec. 12, 2014 (CN) ..... 2014 2 0786653 U

(51) Int. Cl.
*F21K 9/20* (2016.01)
*F21K 9/69* (2016.01)
(Continued)

(52) U.S. Cl.
CPC ..... *F21V 17/105* (2013.01); *F21K 9/20* (2016.08); *F21K 9/69* (2016.08); *F21V 5/007* (2013.01);
(Continued)

(58) Field of Classification Search
CPC ..... F21V 5/007; F21V 17/105; F21V 23/005
(Continued)

(56) References Cited

U.S. PATENT DOCUMENTS 7,338,189 B2 3/2008 Kovacik
8,651,711 B2 2/2014 Rudisill
(Continued)

FOREIGN PATENT DOCUMENTS

CN 101315167 A 12/2008
CN 102410462 B 4/2012
(Continued)

OTHER PUBLICATIONS

Extended European Search Report issued in EP15867203.0, dated Jan. 22, 2018, 8 pages.
(Continued)

*Primary Examiner* — William N Harris
(74) *Attorney, Agent, or Firm* — Arch & Lake LLP

(57) ABSTRACT

An optical module is provided for covering and being assembled on a light source module and providing light distribution and insulation protection for the light source module. The optical module includes a body comprising an optical portion and a power supply drive accommodating portion. The optical module also includes a mounting portion formed to integrally extend from the body. The optical portion is provided with a plurality of lens units that are formed to integrally project along a first direction from a surface of the body. The power supply drive accommodating portion is provided with an accommodating space formed to integrally extend along the first direction from the surface of the body so as to accommodate the power supply drive. The mounting portion at least partially accommodates a mag-
(Continued)

netic mounting element that includes a nonmagnetic base and a strong magnet which is connected integrally with the nonmagnetic base.

21 Claims, 7 Drawing Sheets

(51) Int. Cl.

| | |
|---|---|
| ***F21V 5/00*** | (2018.01) |
| ***F21V 17/06*** | (2006.01) |
| ***F21V 17/10*** | (2006.01) |
| ***F21V 17/12*** | (2006.01) |
| ***F21V 23/00*** | (2015.01) |
| ***F21V 23/02*** | (2006.01) |
| ***F21Y 105/10*** | (2016.01) |
| ***F21Y 115/10*** | (2016.01) |

(52) U.S. Cl.
CPC ..... *F21V 17/06* (2013.01); *F21V 17/10* (2013.01); *F21V 17/12* (2013.01); *F21V 23/005* (2013.01); *F21V 23/02* (2013.01); *F21Y 2105/10* (2016.08); *F21Y 2115/10* (2016.08)

(58) Field of Classification Search
USPC ..... 362/244, 398
See application file for complete search history.

(56) References Cited

U.S. PATENT DOCUMENTS

| | | | | |
|---|---|---|---|---|
| 2008/0298056 | A1* | 12/2008 | Petersen | F21V 5/007 362/235 |
| 2011/0043120 | A1 | 2/2011 | Panagotacos | |
| 2012/0293998 | A1* | 11/2012 | Mignot | F21V 5/007 362/235 |
| 2013/0258667 | A1* | 10/2013 | Ray | F21V 21/00 362/249.02 |
| 2014/0085886 | A1* | 3/2014 | Kothmeier | F21V 14/06 362/237 |
| 2018/0363881 | A1* | 12/2018 | Zou | F21V 5/04 |

FOREIGN PATENT DOCUMENTS

| | | | |
|---|---|---|---|
| CN | 102449382 | A | 5/2012 |
| CN | 102628572 | A | 8/2012 |
| CN | 102686939 | A | 9/2012 |
| CN | 202791697 | U | 3/2013 |
| CN | 202992900 | U | 6/2013 |
| CN | 203323030 | U | 12/2013 |
| CN | 203336495 | U | 12/2013 |
| CN | 104075176 | A | 10/2014 |
| CN | 203907320 | U | 10/2014 |
| CN | 203927627 | U | 11/2014 |
| CN | 203927634 | U | 11/2014 |
| CN | 203927635 | U | 11/2014 |
| CN | 104456442 | A | 3/2015 |
| CN | 204328899 | U | 5/2015 |
| CN | 105276415 | A | 1/2016 |
| CN | 105508906 | A | 4/2016 |
| EP | 1998105 | A1 | 12/2008 |
| JP | 2013175725 | A | 9/2013 |
| WO | 9810220 | A1 | 3/1998 |
| WO | 2011083386 | A1 | 7/2011 |

OTHER PUBLICATIONS

International Search Report and Written Opinion (including English translation) issued in PCT/CN2015/000843, dated Mar. 8, 2016, 12 pages.
Chinese First Office Action (including English translation) issued in CN201410767253.1, dated Feb. 28, 2017, 11 pages.
Chinese Second Office Action (including English translation) issued in CN201410767253.1, dated Nov. 6, 2017, 11 pages.
Chinese Third Office Action (including English translation) issued in CN201410767253.1, dated May 11, 2018, 13 pages.
Chinese Fourth Office Action (including English translation) issued in CN201410767253.1, dated Nov. 23, 2018, 13 pages.
Chinese First Search Report issued in CN201410767253.1, dated Feb. 20, 2017, 1 page.
Chinese Supplementary Search Report issued in CN201410767253.1, dated May 3, 2018, 1 page.
Chinese First Search Report issued in CN201710013698, dated Dec. 15, 2018, 1 page.

* cited by examiner

MAGNETIC MOUNTING ELEMENT, OPTICAL MODULE, ILLUMINATION MODULE AND ILLUMINATION LAMP

CROSS-REFERENCE TO RELATED APPLICATIONS

The present application is a continuation of PCT Application PCT/CN2015/000843 filed on Dec. 2, 2015, which claims priority to Chinese patent applications 201410767253.1 and 201420786653.2, filed concurrently on Dec. 12, 2014, all of which are incorporated herein by reference in their entireties.

TECHNICAL FIELD

The present disclosure relates to an illumination lamp, in particular to a light-emitting diode (LED) illumination lamp.

BACKGROUND

A ceiling lamp is an illuminating device adsorbed or embedded into a ceiling, is also a main indoor lighting equipment as the same as a pendant lamp, and is such a lamp often used in various situations such as family, office, entertainment place or the like. A traditional ceiling lamp usually consists of a base, a light source and a lampshade, and the light source thereof is generally an energy saving lamp. As there is mercury pollution during the production and after disposal of energy saving lamps and the power consumption of energy saving lamps is slightly larger than that of LEDs, and LEDs have the characteristics of mercury-free and non-toxic properties, no electromagnetic pollution, no harmful rays, energy-conserving and environment-friendly, long service life and the like, at present ceiling lamps gradually adopt LEDs as the light sources to replace energy saving lamps. An LED light source module includes a base and LED beads disposed on the base. The LED light source module is usually mounted into a lamp body by screws or bonded into the lamp body by a bonding agent, and hence can be difficult in disassembly and replacement after assembly. An LED ceiling lamp tends to have the phenomena of aging and burning of the LED light source module after long-term use. For instance, when the LED light source module is damaged and needs to be replaced, the damaged LED light source module must be disassembled by a tool, and then a new LED light source module must be mounted by a tool also. As the replacement operation of the LED light source module must be executed by a professional staff via tools, the operation is inconvenient. Moreover, after the ceiling lamp employing an energy saving lamps as the light source is sold to an end customer, if the energy saving lamp must be replaced by an LED light source module, the operation must be executed by a professional staff, and the update from adoption of an energy saving lamp as the light source to adoption of LEDs as the light sources cannot be completed by the user.

In order to solve the above technical problems, magnets are adopted as mounting elements of the light sources and the base in the industry. The magnets are adsorbed on the base of a ceiling lamp, and then the light sources are mounted on the base. For example, the Chinese utility model patent No. CN 202791697 U discloses an LED light source component of a ceiling lamp and an LED ceiling lamp. The LED light source component comprises a base, LED lamp beads disposed on the base, and a light source mounting structure. The light source mounting structure includes a strong magnet and a connecting piece vertically fixed on a backlight surface of the base. One end of the connecting piece is fixedly connected with the base, and a strong magnet is adsorbed to the other end of the connecting piece. By adoption of the strong magnet, the LED light source component can be adsorbed into a ceiling plate made from a ferromagnetic metal material. Thus, when the LED light source component is damaged and needs to be replaced, the damaged LED light source component is removed and a new LED light source component is adsorbed into the ceiling plate by the strong magnet. No tools are required, and customers can conveniently replace the LED light source components by themselves. However, the light source mounting structure disclosed by the patent has a complex structure, is time consuming in assembly, is not reliable, and has the possibility that the strong magnet is separated from the connecting piece. If the connecting piece structure is omitted, a strong magnet with larger volume must be adopted to realize the adsorbed assembly. As known to all, the strong magnet is a "rare-earth (RE) strong magnet", is formed of sintered neodymium iron boron, has the characteristics of small volume, light weight and strong magnetic property, but is also very expensive in price and is difficult to process. Therefore, the use of large-volume strong magnets cannot help enhancing the market competitiveness of products. Moreover, as for the LED light source component disclosed in the patent, how to directly mount the strong magnet is also a problem that is difficult to resolve.

SUMMARY

An object of the present disclosure is to provide a low-cost magnetic mounting element.

According to a first aspect of the disclosure, an optical module is provided for covering and being assembled on a light source module and providing light distribution and insulation protection for the light source module. The optical module includes a body comprising an optical portion and a power supply drive accommodating portion. The optical module further includes a mounting portion formed to integrally extend from the body. The optical portion is provided with a plurality of lens units that are formed to integrally project along a first direction from a surface of the body. The power supply drive accommodating portion is provided with an accommodating space formed to integrally extend along the first direction from the surface of the body so as to accommodate the power supply drive. The mounting portion at least partially accommodates a magnetic mounting element that includes a nonmagnetic base and a strong magnet which is connected integrally with the nonmagnetic base.

According to a second aspect of the disclosure, illumination module is provided. The illumination module includes a light source module including a light source setting area and a power supply drive area, wherein a plurality of light sources are distributed in the light source setting area, and the power supply drive area is provided with a power driving module which are electrically connected with the light sources to drive the light sources to emit light. The illumination module includes an optical module covering a surface of the light source module and including an optical portion and a power supply drive accommodating portion, wherein the optical portion is provided with a plurality of lens units, the lens units are respectively in one-to-one correspondence with the light sources for light distribution of the light emitted by the light sources, and the power supply drive accommodating portion is configured to accommodate the power driving module. The illumination module further includes at least two magnetic mounting elements assembled on the optical module and adsorbed to be assembled on a base of an illumination lamp, wherein the magnetic mounting elements each include a nonmagnetic base and a strong magnet connected integrally with the nonmagnetic base.

According to a third aspect of the disclosure, an illumination lamp includes a base mounted on a pedestal, an illumination module and a lampshade assembled with the base and configured to accommodate the illumination module. The illumination module includes: an optical module including a power supply drive accommodating portion and an optical portion, in which the optical portion is provided with a plurality of lens units; a light source module including a power supply drive area and a light source setting area, in which a plurality of light sources are disposed in the light source setting area; the power supply drive area is provided with a power driving module electrically connected with the light sources. The lens units are respectively in one-to-one correspondence with the light sources; the power driving module is accommodated into the power supply drive accommodating portion of the optical module. At least two magnetic mounting elements are assembled on the optical module, in which the magnetic mounting elements each include a nonmagnetic base and a strong magnet connected integrally with the nonmagnetic base, and the strong magnet is adsorbed on the base.

Figure 1:
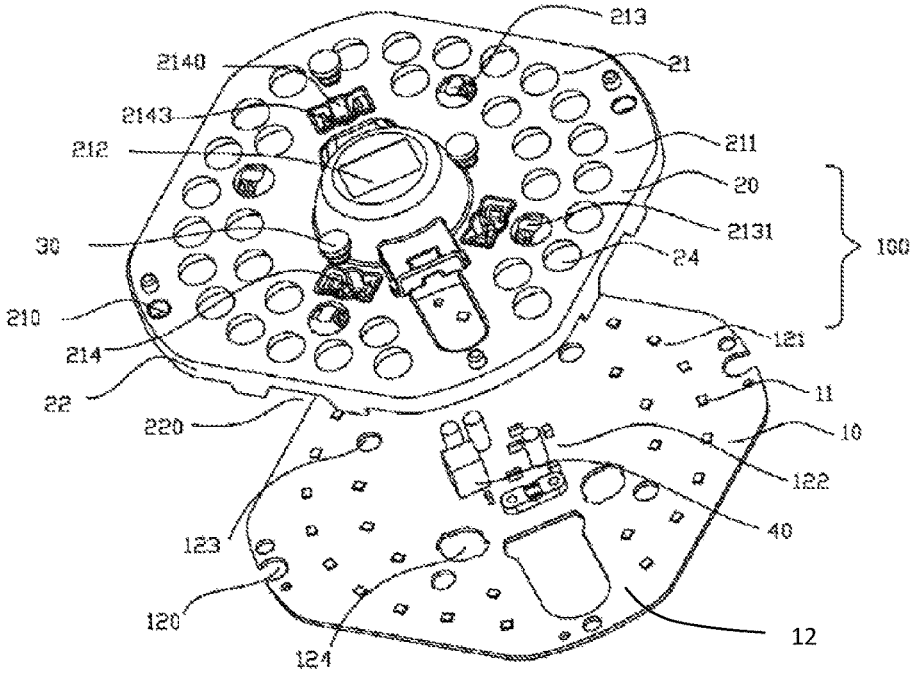
FIG. 1 is a perspective exploded view of an illumination module provided by one or more embodiments of the present disclosure.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Another object of the present disclosure is to provide an optical module equipped with low-cost magnetic mounting elements.

Still another object of the present disclosure is to provide an illumination module provided with low-cost magnetic mounting elements.

Still another object of the present disclosure is to provide an illumination lamp provided with low-cost magnetic mounting elements.

In order to achieve the above object, the present disclosure adopts the following technical proposal: a magnetic mounting element is provided, which is configured for assembling an illumination module on a base of an illumination lamp in an adsorbing way, and comprises a nonmagnetic base and a strong magnet connected integrally with the nonmagnetic base.

Preferably, the volume of the nonmagnetic base is greater than that of the strong magnet.

Preferably, the nonmagnetic base is made from a plastic or nonmagnetic metal material.

Preferably, the nonmagnetic base and the strong magnet are bonded integrally.

Preferably, the nonmagnetic base includes a head assembled with the illumination module and a connecting part combined with the strong magnet, in which a surface of the connecting part combined with the strong magnet is provided with a groove to accommodate a bonding agent.

Preferably, the nonmagnetic base further includes a guide part for connecting the head and the connecting part; the guide part is an inclined plane; and a stepped part is formed between the guide part and the connecting part.

In order to achieve the object, the present disclosure also adopts the following technical proposal: an optical module is provided, which is configured for covering and being assembled on a light source module and providing light distribution and insulation protection for the light source module, and comprises an optical portion and a power supply drive accommodating portion, in which the optical portion is provided with a plurality of lens units; the power supply drive accommodating portion is provided with an accommodating space to accommodate a power supply drive; and the optical module is provided with mounting portions for accommodating the magnetic mounting elements.

Preferably, the power supply drive accommodating portion is disposed in a middle of the optical module; and the optical portion is arranged around the power supply drive accommodating portion.

Preferably, the power supply drive accommodating portion is disposed at one end of the optical module, and the optical portion is disposed at the other end.

Preferably, the nonmagnetic base of the magnetic mounting element includes a head, a connecting part combined with a strong magnet, and a guide part for connecting the head and the connecting part, in which a stepped part is formed at a junction between the guide part and the connecting part; the mounting portion is provided with a pair of fastening parts fastened on the head of the magnetic mounting element and a clamping part leaning against the stepped part of the magnetic mounting element; and the magnetic mounting element is accommodated into the mounting portion by the fastening parts and the clamping part together.

Preferably, the mounting portion is also provided with a pair of accommodating parts which are disposed between the fastening parts along a circumferential direction and extended to be connected with the fastening parts; and the accommodating parts are matched with the outer diameter of the head of the magnetic mounting element and configured to accommodate an outer surface of the head.

Preferably, the optical module further comprises positioning portions capable of accommodating screws; and the positioning portions are used independent of the magnetic mounting elements or both the positioning portions and the magnetic mounting elements are simultaneously used.

In order to achieve the object, the present disclosure also adopts the following technical proposal: an illumination module is provided, which comprises a light source module, an optical module and at least two foregoing magnetic mounting elements. The light source module includes a light source setting area and a power supply drive area; a plurality of light sources are distributed in the light source setting area; and the power supply drive area is provided with a power driving module which is electrically connected with the light sources to drive the light sources to emit light. The optical module covers a surface of the light source module and includes an optical portion and a power supply drive accommodating portion. The optical portion is provided with a plurality of lens units which are respectively in one-to-one correspondence with the light sources for light distribution of the light emitted by the light sources. The power supply drive accommodating portion is configured to accommodate the power driving module. The magnetic mounting elements are assembled on the optical module, run through the light source module, and are adsorbed and assembled on a base of an illumination lamp.

Preferably, the optical module and the light source module are coupled by fasteners.

Preferably, the optical module includes a body and an extension that is formed to vertically extend from an edge of the body to the light source module, in which the extension is extended to exceed the light source module; and the strong magnet of the magnetic mounting element exceeds the extension and is adsorbed on the base of the illumination lamp.

Preferably, the power supply drive accommodating portion is disposed in the middle of the optical module; and the optical portion is arranged around the power supply drive accommodating portion.

Preferably, the power supply drive accommodating portion is disposed at one end of the optical module, and the optical portion is disposed at the other end.

Preferably, the nonmagnetic base of the magnetic mounting element includes a head, a connecting part combined with the strong magnet, and a guide part for connecting the head and the connecting part, in which a stepped part is formed at a junction between the guide part and the connecting part; the optical module is provided with mounting portions to accommodate the magnetic mounting elements, in which the mounting portion is provided with a pair of fastening parts fastened on the head of the magnetic mounting element and a clamping part leaning against the stepped part of the magnetic mounting element; and the magnetic mounting element is accommodated into the mounting portion by the fastening parts and the clamping part together.

Preferably, the mounting portion is also provided with a pair of accommodating parts which are disposed between the fastening parts along the circumferential direction and extended to be connected with the fastening parts; and the accommodating parts are matched with the outer diameter of the head of the magnetic mounting element and configured to accommodate an outer surface of the head.

Preferably, the optical module further comprises positioning portions capable of accommodating screws; and the positioning portions are used independent of the magnetic mounting elements or both are simultaneously used.

In order to achieve the object, the present disclosure also adopts the following technical proposal: an illumination lamp is provided, which comprises a base mounted on a pedestal, an illumination module and a lampshade assembled with the base and configured to accommodate the illumination module. The illumination module includes an optical module, a light source module and the foregoing magnetic mounting elements. The optical module includes a power supply drive accommodating portion and an optical portion; and the optical portion is provided with a plurality of lens units. The light source module includes a power supply drive area and a light source setting area; a plurality of light sources are disposed in the light source setting area; and the power supply drive area is provided with a power driving module electrically connected with the light sources. The lens units are respectively in one-to-one correspondence with the light sources; and the power driving module is accommodated into the power supply drive accommodating portion of the optical module. The magnetic mounting elements are adsorbed on the base.

Preferably, the magnetic mounting elements are assembled on the optical module, run through the light source module, and are adsorbed and assembled on the base.

Preferably, the positions at which the magnetic mounting elements are assembled on the optical module are matched with the center of gravity of the illumination module.

Compared with the art of state, the magnetic mounting element and the optical module, the illumination module and the illumination lamp comprising the magnetic mounting elements, provided by the present disclosure, have the advantages of low cost, simple structure and reliable performance.

The present disclosure provides a magnetic mounting element 30 and an optical module 20 comprising the magnetic mounting elements 30, an illumination module 100, and an illumination lamp. The illumination lamp comprises a ferroic base (not illustrated in the figure), the illumination module 100 assembled on the base, and a lampshade (not illustrated in the figure). The illumination module 100 provided by the present disclosure may be used in a conventional lighting device for update (for instance, the conventional fluorescent lamp is replaced by the illumination module 100), and may also be applied in a new illumination lamp.

As illustrated in FIGS. 1 to 5, the illumination module 100 provided by one or more embodiments of the present disclosure comprises a light source module 10, a power driving module 40, an optical module 20, and magnetic mounting elements 30 assembled on the optical module 20.

The light source module 10 includes a circuit board 12 and light sources 11. In one or more embodiments, the circuit board 12 is in a square shape, and the configuration can achieve the maximum utilization rate in the process of cutting an entire circuit board. However, in other embodiments, the shape of the circuit board 12 is not limited to be square and may also be circular, polygonal, irregular, or the like. The circuit board 12 is provided with a light source setting area 121 and a power supply drive area 122.

In one or more embodiments of the present disclosure, the power supply drive area 122 is disposed in the middle of the circuit board 12, and the light source setting area 121 is arranged around the power supply drive area 122. In the light source setting area 121, a plurality of light sources 11 are distributed at a certain interval, are respectively bonded to an upper surface of the circuit board 12, and achieve electrical connection through wirings in the circuit board 12.

In embodiments of the present disclosure, the light sources are LED light sources. The distribution of the light sources 11 not only can ensure enough spacing between the light sources so as to comply with safety regulations but also can save space and avoid the result that the size of the circuit board 12 becomes overlarge. In the power supply drive area 122, the power driving module 40 is bonded into the area, and is electrically connected with the light sources 11 through the wirings disposed in the circuit board 12, so as to drive the light sources 11 to emit light.

The power driving module 40 is also connected with an external commercial power through leads (not illustrated in the figure). The commercial electrical power enters the power driving module 40 through the leads, is subjected to voltage transformation by the power driving module 40, and is then supplied to the light sources 11. In other embodiments, the power driving module 40 may also be electrically connected with the circuit board 12 through an adapter plate (not illustrated in the figure), so as to be electrically connected with the light sources 11. Generally speaking, the light sources 11 are arranged around the power driving module 40.

In order to be assembled with the optical module 20, the circuit board 12 is also provided with a plurality of mounting holes 123 which are alternately distributed with the light sources 11. In one or more embodiments of the present disclosure, there are provided four mounting holes 123, and the mounting holes are roughly distributed in a square. Openings 124 distributed in a triangular are arranged at the periphery of the power driving module 40. The openings 124 are in the shape of a waist drum and configured to be matched with corresponding structures of the optical module 20. A pair of circular semi-enclosed mounting holes 120 are also disposed at the diagonal positions of the circuit board 12. In addition, the wiring distribution of the circuit board 12 complies with the safety regulations of Class II lamps. Thus, when users contact the illumination module 100, there is no possibility of contacting live parts or electrified bodies, so the safety of the illumination module 100 can be greatly improved. Therefore, the lead (not illustrated in the figure) connected with the power driving module 40 has positive and negative poles, eliminating a grounded third pole.

The optical module 20 is made from an insulating material, preferably one of polycarbonate (PC), Acrylic or polymethyl methacrylate (PMMA). The three materials have the advantages of light weight, low cost and high transmittance, and are relatively ideal materials for preparing light guide components. The optical module 20 is matched with the light source module 10 in shape, and includes a square body 21 and an extension 22 formed to vertically extend in the direction from the peripheral edge of the body 21 to the light source module 10. The body 21 is bonded to the circuit board 12 of the light source module 10, and the extension 22 is extended to exceed the edge of the circuit board 12 and configured for providing insulation protection to the electric components of the illumination module 100.

Figure 3:
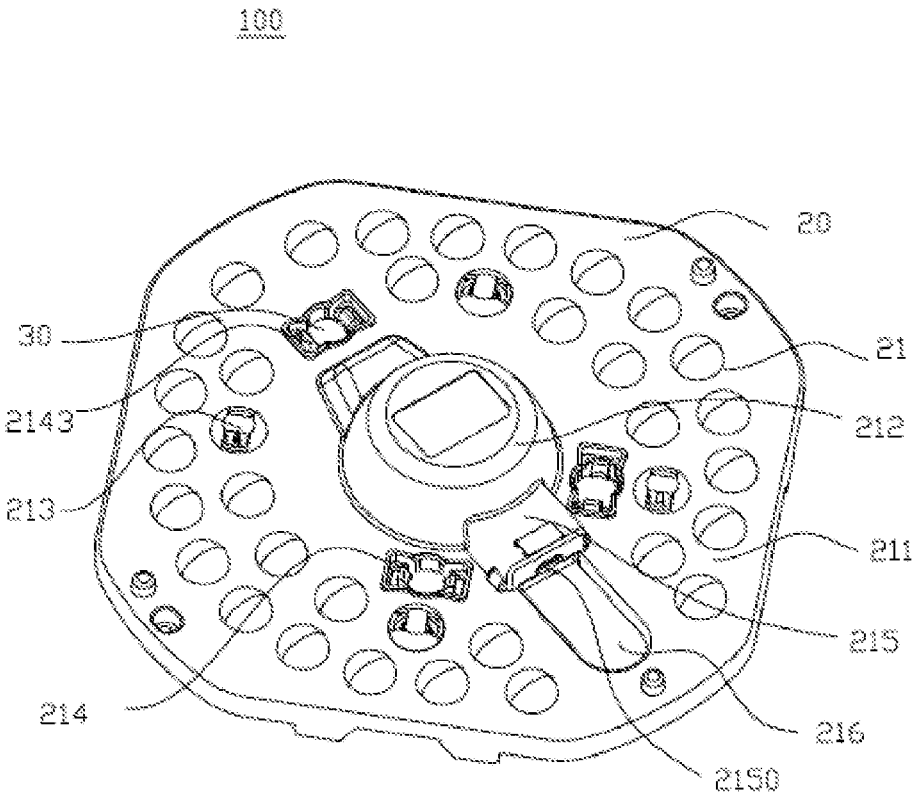
FIG. 3 is a perspective assembly diagram of the illumination module provided by one or more embodiments of the present disclosure.
Figure 4:
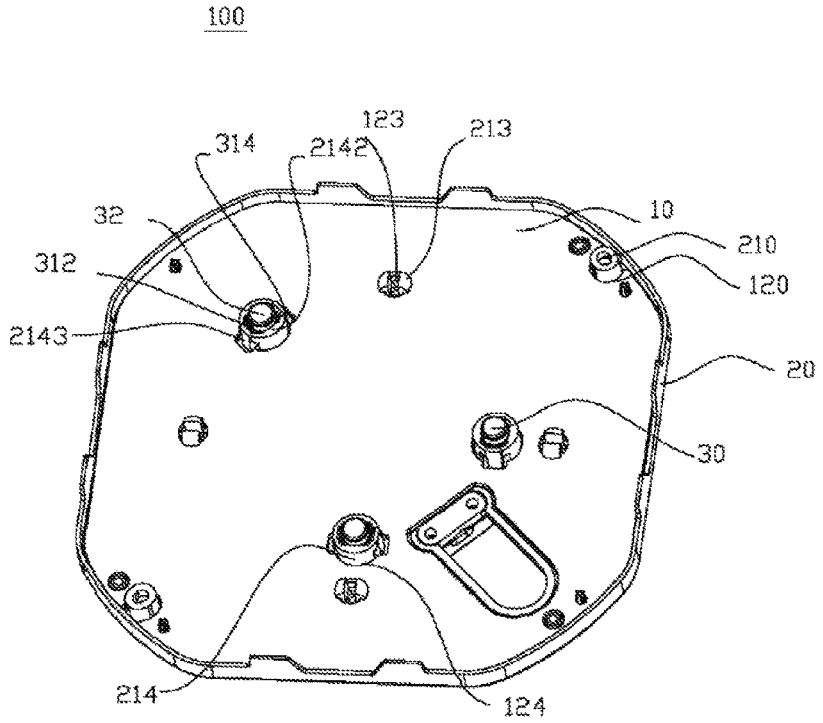
FIG. 4 is a perspective assembly diagram of the illumination module provided by one or more embodiments of the present disclosure viewed from another angle.
Figure 5:
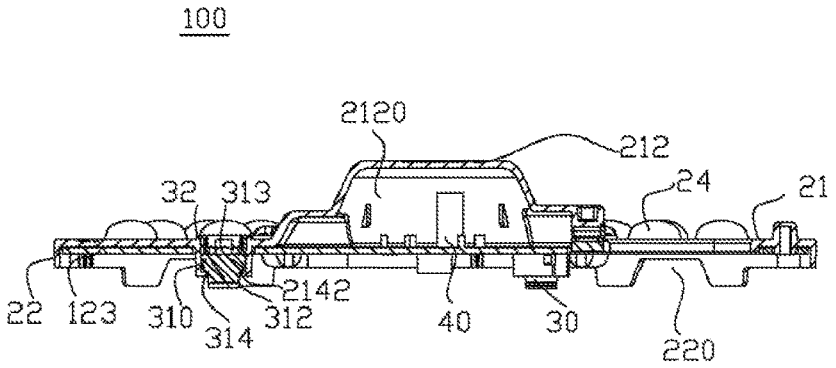
FIG. 5 is a sectional view of the illumination module as illustrated in FIG. 3 along the A-A direction.
Figure 6:
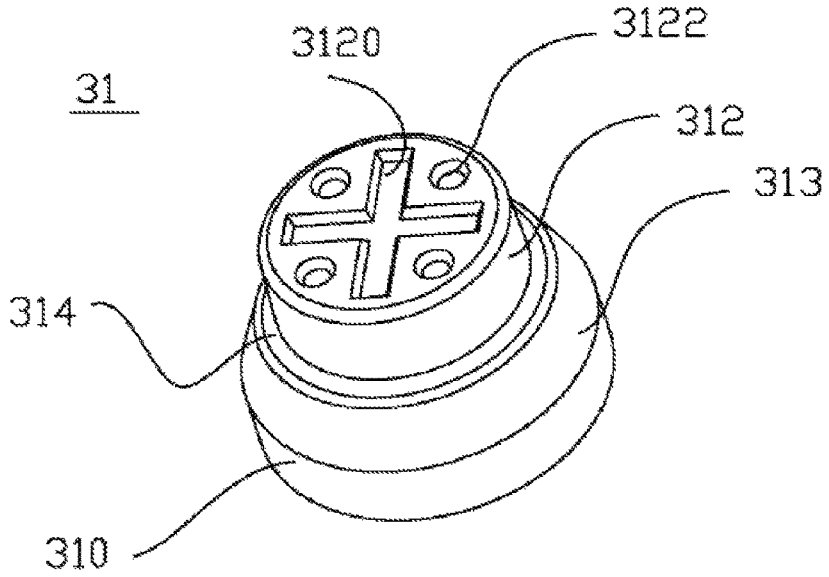
FIG. 6 is a perspective view of a nonmagnetic base of a magnetic mounting element provided by one or more embodiments of the present disclosure.

As shown in FIGS. 3 and 5, the body 21 is provided with a power supply drive accommodating portion 212 disposed in the middle of the body and an optical portion 211 arranged around the power supply drive accommodating portion 212. The optical portion 211 is provided with a plurality of lens units 24. The lens units are integrally formed with the body 21 and respectively in one-to-one correspondence with the light sources 11 distributed on the circuit board 12, and cover the light sources 11 from the above for secondary light distribution of the emergent light of the light sources 11. The power supply drive accommodating portion 212 is formed to bulge from the middle of the body 21 so as to provide an accommodating space 2120.

The power driving module 40 disposed at the power supply drive area 122 of the circuit board 12 of the light source module 10 is projected into the accommodating space 2120 and under insulation protection and mechanical protection provided by the power supply drive accommodating portion 212. Therefore, the optical module 20 provided by the present disclosure has double functions, not only provides secondary light distribution for the light source module 10 but also provides insulation protection for the light source module 10, and meanwhile can protect the light sources 11 and the drive module 40 from external damage. One end of the power supply drive accommodating portion 212 extend integrally to form a tail 215 and an opening 216 that is provided in the body and close to the tail 215. Correspondingly, the light source module 10 has an opening 126 that communicates with the opening 216 in the up-down direction. The wirings (not illustrated) are connected with the power driving module 40, then is held at the tail 215, folded within the openings 216, 126 and connected to the electric supply from the other side of the light source module 10. The tail 215 is provided a groove 2150 for holding wirings and preventing the wirings from electrically disconnecting from the power driving module 40 due to pulling.

The light source module 10 and the optical module 20 provided by the present disclosure are coupled together by fasteners, have simple structure, and are easy in operation. In order to be matched with the light source module 10, the body 21 bonded to the circuit board 12 is provided with four fastening portions 213 matched with the mounting holes 123 of the circuit board 12. Circular accommodating recesses 2130 are formed to run through the body 21 first. Each fastening portion 213 includes an "I"-shaped base part 2131 that is formed to partially project from the surface of the body 21, and a pair of fasteners 2132 formed to respectively extend in the direction from two side edges of the base part 2131 towards the light source module 10. The fasteners 2132 are arranged in opposite to each other. A hook 2133 which is extended outwards and provided with a quarter cambered outer surface is formed at a free end of the fastening portion. When the light source module 10 and the optical module 20 are assembled together, the cambered hooks 2133 is helpful for passing through the mounting holes 123 disposed on the circuit board 12 of the optical module 10, and are extruded by the mounting holes 123 to move close to each other, and subsequently, the hooks 2133 are restored after running through the mounting holes 123 and are fastened with the edges of the mounting holes 123 of the circuit board 12, and hence the light source module 10 and the optical module 20 are attached together.

In order to accommodate the magnetic mounting elements 30, three mounting portions 214 are also formed to extend in the second direction opposite to the first direction (in some embodiments of the present disclosure, the second direction face upwards) at the periphery of the power supply drive accommodating portion 212 of the body 21 of the optical module 20, at positions corresponding to the openings 124 of the circuit board 12. The positions of the mounting portions 214 are set according to the center of gravity of the illumination module 100, and ensure that the illumination module 100 can maintain balance when it is adsorbed on the base through the magnetic mounting elements 30.

Figure 2:
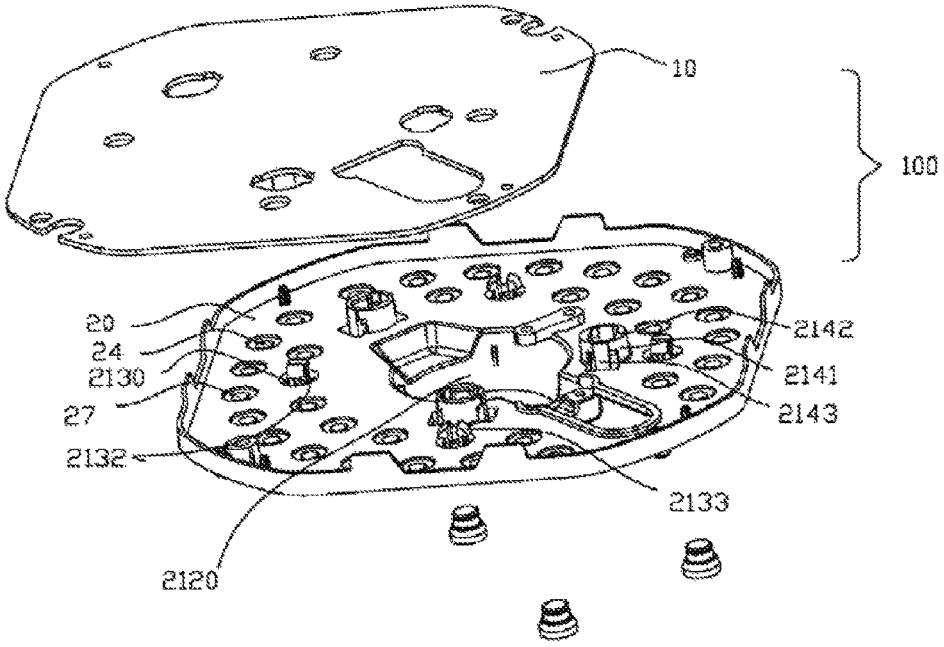
FIG. 2 is a perspective exploded view of the illumination module as illustrated in FIG. 1 viewed from another angle.

As illustrated in FIGS. 1-2, the body 21 is provided with openings 2140 in the shape of a waist drum. The middle portion of the opening is cambered, and both end portions thereof are trapezoidal. A pair of cambered accommodating parts 2141 are formed to oppositely extend in the direction from the edge of a cambered part of the opening 2140 towards the light source module 10, and free tail ends of the cambered accommodating parts are connected integrally by a ring. A cambered clamping part 2142 is formed to partially extend in the direction from a bottom edge of the accommodating part 2141 towards another accommodating part 2141. A pair of buckled fastening parts 2143 are formed at the ring between the accommodating parts 2141 to extend in the direction towards the opening 2140. An inclined guide surface (not indicated) is formed in the direction where the fastening part 2143 faces another fastening part 2143. Thus, the mounting portion 214 at least includes the accommodating parts 2141, the fastening parts 2143 and the clamping part 2142, which are matched with each other to accommodate the magnetic mounting element 30 together. Detailed description will be given below.

Figure 7:
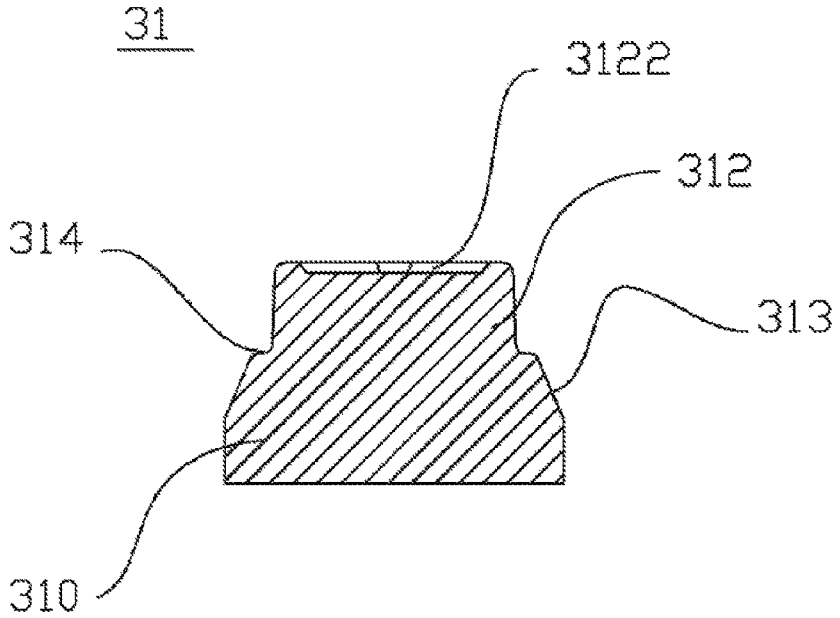
FIGS. 7 and 8 are sectional views of the nonmagnetic base of the magnetic mounting element provided by tone or more embodiments of the present disclosure.
Figure 8:
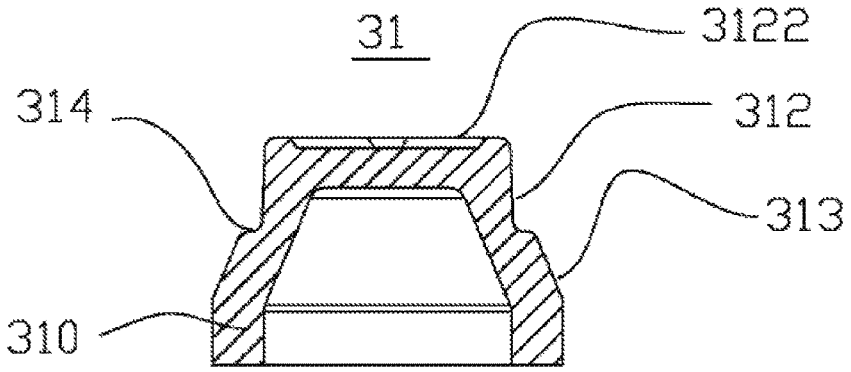

As illustrated in FIGS. 4 to 8, the magnetic mounting element 30 includes a nonmagnetic base 31 assembled with the optical module 20 and a strong magnet 32 fixedly connected with the nonmagnetic base 31 to form an integrated structure and adsorbed on the base of the illumination lamp. The nonmagnetic base 31 may be formed of a plastic or metallic material through molding or press forming process. Thus, the one or more embodiments of the nonmagnetic base 31 as illustrated in FIGS. 7 and 8 of the present disclosure may have a solid structure (as illustrated in FIG. 7) or a hollow structure (as illustrated in FIG. 8). Specifically, the nonmagnetic base 31 includes a cylindrical head 310, a cylindrical connecting part 312, and a guide part 313 for connecting the head 310 and the connecting part 312, in which the diameter of the head 310 is greater than that of the connecting part 312, so the guide part 313 is beveled, and a stepped part 314 is formed between the guide part 313 and the connecting part 312. A crisscross groove 3120 is formed on a surface of the connecting part 312, may accommodate a bonding agent for the integral connection with the strong magnet 32. In order to enhance the bonding effect, the connecting part 312 is also provided with four dotted recesses 3122 which are disposed in blank areas at the periphery of the crisscross groove 3120. In other embodiments, the connecting part 312 may be provided with a recess configured to partially accommodate the strong magnet 32, and the connecting part and the strong magnet are bonded integrally. The connecting part and the strong magnet may also be combined integrally by a screw.

When the magnetic mounting element 30 is assembled on the mounting portion 214 of the optical module 20, the guide part 313 provided with the inclined plane slides along the inclined guide surface of the fastening part 2143, until the fastening part 2143 press against the top surface of the head 310 and the clamping part 2142 is clamped to the stepped part 314. At this point, the head 310 is clamped between the fastening part 2143 and the clamping part 2142 in the up-down direction, and is accommodated between a pair of cambered accommodating parts 2141 along the circumferential direction. The connecting part 312 and the strong magnet 32 integrally connected with the connecting part 312 are projected to exceed a tail end of the mounting portion 214, and also exceed the extension 22 of the optical module 20, so as to ensure the reliable adsorption with the base.

At the diagonal positions of the body 21 of the optical module 20, corresponding to the diagonal positions of the circuit board 12 of the light source module 10, a pair of positioning portions 210 are formed by an extension and are respectively extended into the mounting holes 120 of the light source module 10; and screws can be provided to run through the positioning parts 210 and are in screwed connection with the base. Therefore, the illumination module 100 provided by the present disclosure may adopt screwed connection and/or adsorbed connection.

The extension 22 can be partially cut to form spaces 220 for manual operation. When the illumination module 100 is assembled on the base or disassembled from the base, the illumination module 100 may be held by hand through the spaces 220.

The lens units 24 of the optical module 20 are hemispherical lenses 24, and a central part of an incident surface of the hemispherical lens is concaved to form an accommodating cavity 27 which is configured to accommodate the light source 11 and axisymmetric relative to the hemispherical lens 24. By adoption of this configuration, the incident surface 28 can maximally receive light emitted by the LED light source 11. In addition, a single LED generally adopts 120 DEG Lambert emission; the distance between two LED light sources 11 is selected to allow uniform light to be obtained on a light-emitting surface after light is mixed with each other along a certain distance; by means of the lens, the luminous angle of the LED light source 11 can be further expanded; and as illustrated in FIG. 9, the light is deviated towards the direction away from an optical axis after refraction for two times, so that the requirement of uniform emission can be satisfied at a lower height, and hence the height of the illumination lamp can be reduced and ultrathin illumination lamp can be obtained.

Figure 9:
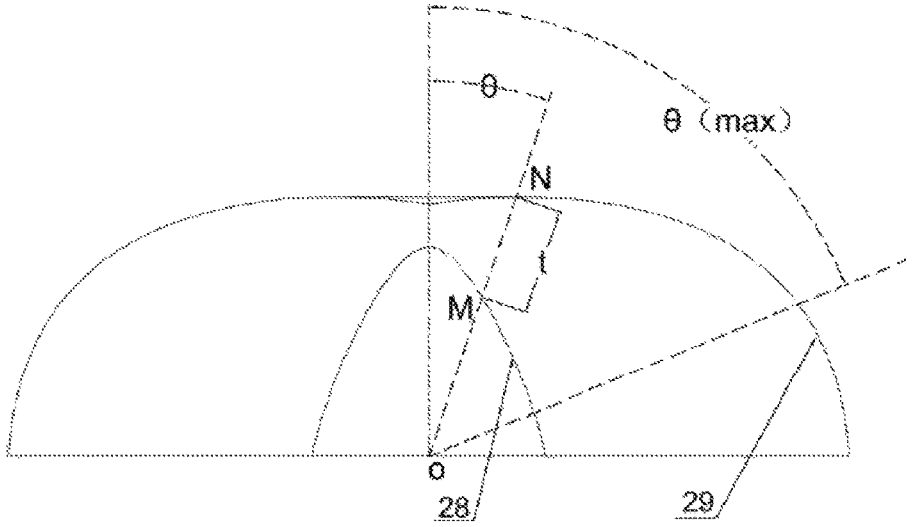
FIG. 9 is a side view of a lens unit in the one or more embodiments of the present disclosure.

As illustrated in FIG. 9, a light-emitting surface 29 of the hemispherical lens 24 is not a regular hemispherical structure but an approximate ellipsoid structure. Because the accommodating cavity 27 is concavely formed on the incident surface 28, the hemispherical lens 24 is of a structure with a thin center and two thick sides. A straight line having an included angle $\theta$ with respect to the optical axis is led from an origin O of the lens and respectively intersected with the incident surface 28 and the light-emitting surface 29 of the lens; intersection points are respectively M and N; the length of the line segment MN is the thickness t of the lens; and the thickness t of the lens is monotonously progressively increased along with the increase of $\theta$ within the range $0 \leq \theta \geq \theta(\max)$, in which $\theta(\max)$ is ranged from 45° to 90°. Due to the setting of the hemispherical lens 24, the included angle between paraxial light and the optical axis is increased after the paraxial light runs through the incident surface, and is further increased after the paraxial light runs through the light-emitting surface, so that the hemispherical lenses 24 can have better diffusion effect, and meanwhile, the problem of large paraxial light intensity of the LED light sources 11 can be solved and more uniform flood lighting can be achieved.

As illustrated in FIG. 9, the center of the light-emitting surface 29 of the hemispherical lens 24 is concaved to form an inverted-cone diffusion part. The photodiffusion function can be achieved by increasing the refraction angle when the light is emitted out from the light-emitting surface 29 after increasing the incidence angle when the light is projected to the light-emitting surface 29.

In the present disclosure, the incident surface 28 and the light-emitting surface 29 of the hemispherical lens 24 may also be subjected to surface treatment, and the incident surface 28 and the light-emitting surface 29 are respectively treated to form a polished surface and a frosted surface. The function of photodiffusion and uniform light can be achieved because of scattering properties of the frosted surface.

Figure 10:
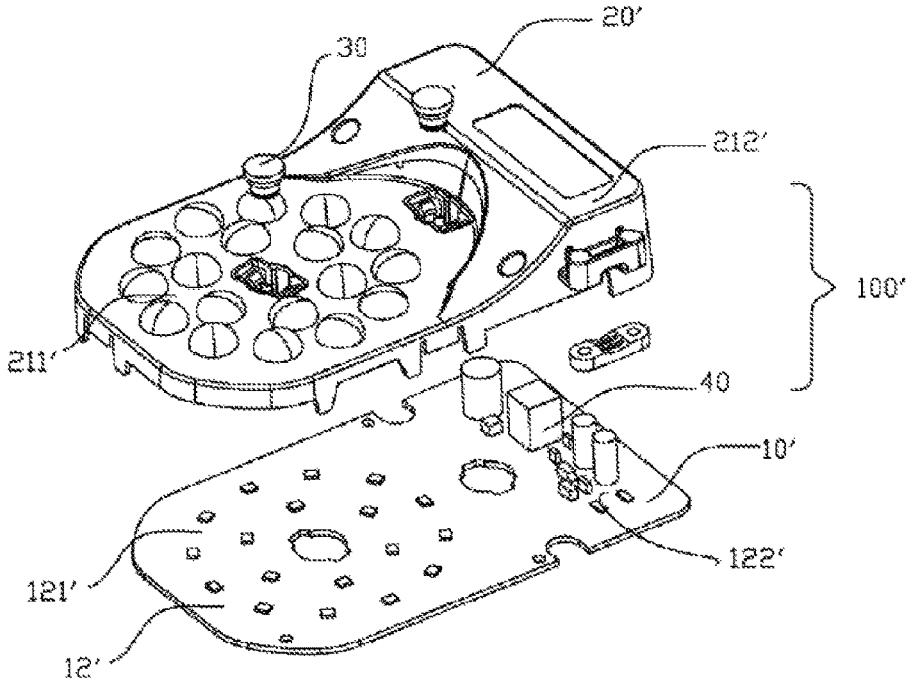
FIG. 10 is a perspective exploded view of an illumination module provided by one or more embodiments of the present disclosure.
Figure 11:
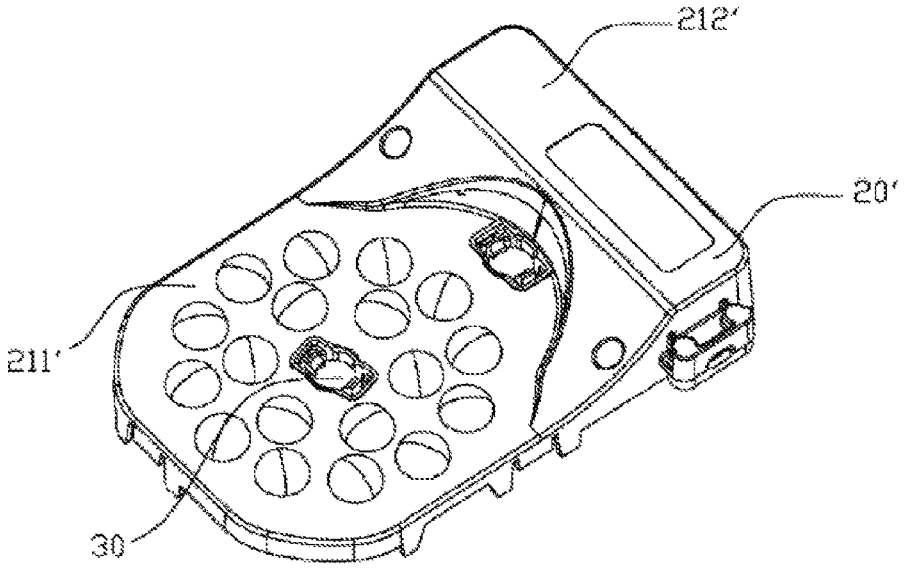
FIG. 11 is a perspective assembly diagram of the illumination module as illustrated in FIG. 10.

As illustrated in FIGS. 10 and 11, the present disclosure further provides an illumination module 100' in accordance with one or more embodiments. Compared with the illumination module 100 provided by one or more embodiments, the difference is as follows: as for a light source module 10', a light source setting area 121' and a power supply drive area 122' of a circuit board 12' of the light source module are respectively disposed at both ends of the circuit board 12', and therefore an optical portion 211' and a power supply drive accommodating portion 212' of the corresponding optical module 20' are also respectively disposed at both ends of this optical module 20', so as to respectively correspond to light sources 11 and a power driving module 40 of the light source module 10'. In addition, as the volume of the illumination module 100' is smaller, the illumination module is provided with two magnetic mounting elements 30 which are respectively disposed at a joint position of the optical portion 211' and the power supply drive accommodating portion 212' and the middle of the optical portion 211'. The positions of the magnetic mounting elements 30 are also matched with the center of gravity of the illumination module 100'.

It should be noted that the embodiments of the present disclosure can have preferred implementations but do not limit the present disclosure in any way, and may be changed or modified into equivalent embodiments by those skilled in the art by utilization of the foregoing disclosed technical content; and any modification or equivalent change and modification made to the above embodiments, on the basis of the technical essence of the present disclosure without departing from the content of the technical proposals of the present disclosure, shall still fall within the scope of the technical proposals of the present disclosure.

What is claimed is:

1. An optical module, configured for covering and being assembled on a light source module and providing light distribution and insulation protection for the light source module, comprising:

a body comprising an optical portion and a power supply drive accommodating portion; and a mounting portion formed to extend from the body, wherein the optical portion is provided with a plurality of lens units that are formed to project along a first direction from a surface of the body;

wherein the power supply drive accommodating portion is provided with an accommodating space formed to extend along the first direction from the surface of the body so as to accommodate a power supply drive; and wherein the mounting portion at least partially accommodates a magnetic mounting element that includes a nonmagnetic base and a magnet which is connected with the nonmagnetic base, wherein the nonmagnetic base of the magnetic mounting element includes a head and a connecting part combined with a magnet, in which at least part of the head is accommodated into the mounting portion.

2. The optical module according to claim 1, wherein the power supply drive accommodating portion is disposed in a middle of the optical module; and the optical portion is arranged around the power supply drive accommodating portion.

3. The optical module according to claim 1, wherein the power supply drive accommodating portion is disposed at one end of the optical module, and the optical portion is disposed at an other end.

4. The optical module according to claim 1, wherein the mounting portion and the magnetic mounting element are coupled by fasteners.

5. The optical module according to claim 1, wherein the mounting portion is provided with fastening parts fastened with the head of the magnetic mounting element.

6. The optical module according to claim 5, wherein the mounting portion is also provided with accommodating parts which are matched with an outer diameter of the head of the magnetic mounting element and configured to accommodate an outer surface of the head.

7. The optical module according to claim 1, wherein the optical module further comprises at least two positioning portions capable of accommodating screws; and the positioning portions are used independent of the magnetic mounting elements or both are simultaneously used.

8. The optical module according to claim 7, wherein the positioning portions are disposed at a periphery of the optical portion of the optical module; and the mounting portions are disposed in the optical portion or at the periphery of the optical portion.

9. The optical module according to claim 8, wherein the mounting portions are disposed in the optical portion and arranged around the power supply drive accommodating portion.

10. An illumination module, comprising:

a light source module including a light source setting area and a power supply drive area, wherein a plurality of light sources are distributed in the light source setting area, and the power supply drive area is provided with a power driving module which is electrically connected with the light sources to drive the light sources to emit light;

an optical module covering a surface of the light source module and including an optical portion and a power supply drive accommodating portion, wherein the optical portion is provided with a plurality of lens units, the lens units are respectively in one-to-one correspondence with the light sources for light distribution of the light emitted by the light sources, and the power supply drive accommodating portion is configured to accommodate the power driving module; and at least two magnetic mounting elements assembled on the optical module and adhered to be assembled, wherein the magnetic mounting elements each include a nonmagnetic base and a magnet connected with the nonmagnetic base, wherein the nonmagnetic base of the magnetic mounting element includes a head and a connecting part combined with a magnet, in which at least part of the head is accommodated into a mounting portion that is formed to extend from a body of the optical module.

11. The illumination module according to claim 10, wherein the optical module includes the body; the optical portion is provided with the lens units which are formed to project along a first direction from a surface of the body; the power supply drive accommodating portion is provided with an accommodating space formed to extend along the first direction from the surface of the body so as to accommodate the power driving module; and wherein the optical module further includes at least two mounting portions formed to extend from the body; and the at least two mounting portions at least partially accommodate the at least two magnetic mounting elements.

12. The illumination module according to claim 10, wherein the optical module and the light source module are coupled by fasteners.

13. The illumination module according to claim 10, wherein the optical module includes a body and an extension formed to vertically extend from the body to the light source module;

wherein the extension is extended to extend beyond the light source module; and wherein a magnet of each magnetic mounting element is extended beyond the extension.

14. The illumination module according to claim 10, wherein the power supply drive accommodating portion is disposed in a middle of the optical module, and the optical portion is arranged around the power supply drive accommodating portion.

15. The illumination module according to claim 10, wherein the power supply drive accommodating portion is disposed at one end of the optical module, and the optical portion is disposed at an other end.

16. The illumination module according to claim 10, wherein the mounting portion and the magnetic mounting element are coupled by fasteners.

17. The illumination module according to claim 16, wherein the nonmagnetic base of the magnetic mounting element includes a head and a connecting part combined with a magnet, in which the head is accommodated into the mounting portion of the optical module; and the connecting part is connected with the magnet.

18. The illumination module according to claim 17, wherein the mounting portion is provided with fastening parts fastened with the head of the magnetic mounting element.

19. The illumination module according to claim 18, wherein the mounting portion is also provided with accommodating parts which are matched with an outer diameter of the head of the magnetic mounting element and configured to accommodate an outer surface of the head.

20. The illumination module according to claim 17, wherein the magnetic mounting element further includes a guide part for connecting the head and the connecting part; and the mounting portion is provided with a pair of fastening parts fastened on the head of the magnetic mounting element and configured to accommodate the magnetic mounting element into the mounting portion.

21. The illumination module according to claim 10, wherein the optical module is also provided with positioning portions capable of accommodating screws; and the positioning portions are used independent of the magnetic mounting elements or both are simultaneously used to assemble the illumination module on the base of the illumination lamp.

* * * * *